US005636700A

United States Patent [19]

Shamburger, Jr.

[11] Patent Number: 5,636,700

[45] Date of Patent: Jun. 10, 1997

[54] ROLLER CONE ROCK BIT HAVING IMPROVED CUTTER GAUGE FACE SURFACE COMPACTS AND A METHOD OF CONSTRUCTION

[75] Inventor: James M. Shamburger, Jr., Spring Harris County, Tex.

[73] Assignee: Dresser Industries, Inc., Dallas, Tex.

[21] Appl. No.: 368,305

[22] Filed: Jan. 3, 1995

[51] Int. Cl.[6] ..... F21B 10/16; F21B 10/50

[52] U.S. Cl. ..... 175/331; 76/108.4; 175/374; 175/431

[58] Field of Search ..... 175/331, 374, 175/431; 76/108.2, 108.4

[56] References Cited

U.S. PATENT DOCUMENTS

| | | | |
|---|---|---|---|
| Re. 32,036 | 11/1985 | Dennis | 175/429 |
| 1,306,674 | 6/1919 | Esseling . | |
| 1,996,322 | 4/1935 | Carlson . | |
| 2,014,806 | 9/1935 | Howard et al. . | |
| 2,027,700 | 1/1936 | Rogatz | 175/378 |
| 2,081,195 | 6/1937 | Catland et al. . | |
| 2,103,611 | 12/1937 | Catland et al. . | |
| 2,117,481 | 5/1938 | Howard . | |
| 2,121,202 | 6/1938 | Kiligore | 175/371 |
| 2,123,453 | 7/1938 | Catland et al. . | |
| 2,358,642 | 9/1944 | Kammerer . | |
| 2,412,915 | 12/1946 | Sewell . | |
| 2,470,695 | 5/1949 | Goodwin et al. . | |
| 2,514,586 | 7/1950 | Natland et al. . | |
| 2,661,931 | 12/1953 | Swart . | |
| 2,667,334 | 1/1954 | Ortloff . | |
| 2,774,571 | 12/1956 | Morlan | 175/341 |
| 2,804,282 | 8/1957 | Spengler, Jr. | 175/378 |
| 2,893,696 | 7/1959 | McGuire . | |
| 2,901,223 | 8/1959 | Scott . | |
| 3,075,592 | 1/1963 | Overly et al. . | |
| 3,091,300 | 5/1963 | Hammer | 175/333 |
| 3,095,053 | 6/1963 | Pistole et al. | 175/327 |
| 3,096,835 | 7/1963 | Neilson . | |
| 3,100,544 | 8/1963 | Overly et al. | 175/333 |
| 3,125,175 | 3/1964 | Medlock et al. . | |
| 3,126,067 | 3/1964 | Schumacher, Jr. | 175/374 |
| 3,134,447 | 5/1964 | McElya et al. | 175/332 |
| 3,137,355 | 6/1964 | Schumacher, Jr. | 175/374 |
| 3,174,564 | 3/1965 | Morlan . | |
| 3,250,337 | 5/1966 | Demo | 175/343 |
| 3,311,181 | 3/1967 | Fowler | 175/426 |
| 3,389,761 | 6/1968 | Ott | 175/374 |
| 3,461,983 | 8/1969 | Hudson et al. | 175/375 |
| 3,467,448 | 9/1969 | Galle . | |
| 3,604,523 | 9/1971 | Lichte . | |
| 3,656,764 | 4/1972 | Robinson . | |

(List continued on next page.)

FOREIGN PATENT DOCUMENTS 201992 3/1979 United Kingdom .

OTHER PUBLICATIONS

Correspondence to Customers, MEGAdiamond, Megadiamond Announces a Unique Service, Oct. 6,1981 (4 pgs.).
"Kor King" Diamant Boart Stratabit, 1988.
"readily available fluid . . . " (No date).
"PDC Bits Matrix", Security DBS, pp. 32–39, (undated).

*Primary Examiner*—David J. Bagnell
*Attorney, Agent, or Firm*—Baker & Botts, L.L.P.

[57] ABSTRACT

A roller cone rock bit (10) is provided that has improved cutter cone gauge face surface compacts. The roller cone rock bit (10) includes a bit body (12) having at least one downwardly extending arm (28) terminating in a spindle (30). A cutter cone (20) has a gauge face surface (24) and has a plurality of holes (45) formed in the gauge face surface (24). Each hole (45) in the plurality of holes has an axis (52) oriented at an acute angle with respect to the gauge face surface (24). A bearing assembly (32, 34 and 36) is disposed between the spindle (30) and the cutter cone (20) for rotary load-bearing engagement. A plurality of compacts (22) are disposed in the plurality of holes (45). Each compact (22) is oriented at an acute angle with respect to the gauge face surface (24) according to the axis (52) of each hole (45).

24 Claims, 2 Drawing Sheets

U.S. PATENT DOCUMENTS

| | | | |
|---|---|---|---|
| 3,739,864 | 6/1973 | Cason, Jr. et al. | 175/228 |
| 3,858,671 | 1/1975 | Kita et al. | 175/426 |
| 3,921,735 | 11/1975 | Dysart . | |
| 3,922,038 | 11/1975 | Scales | 384/95 |
| 3,948,330 | 4/1976 | Langford, Jr. | 175/339 |
| 3,952,815 | 4/1976 | Dysart . | |
| 4,006,788 | 2/1977 | Garner | 175/405.1 |
| 4,014,395 | 3/1977 | Pearson | 175/426 |
| 4,056,153 | 11/1977 | Miglierini . | |
| 4,058,177 | 11/1977 | Langford, Jr. et al. | 175/374 |
| 4,073,548 | 2/1978 | Walters . | |
| 4,087,100 | 5/1978 | Yoshihashi et al. . | |
| 4,092,054 | 5/1978 | Dye . | |
| 4,098,358 | 7/1978 | Klima . | |
| 4,102,419 | 7/1978 | Klima . | |
| 4,109,737 | 8/1978 | Bovenkerk | 175/430 |
| 4,140,189 | 2/1979 | Garner | 175/431 |
| 4,148,368 | 4/1979 | Evans | 175/428 |
| 4,156,329 | 5/1979 | Daniels et al. | 51/295 |
| 4,158,394 | 6/1979 | Ernst et al. . | |
| 4,176,848 | 12/1979 | Lafuze . | |
| 4,179,003 | 12/1979 | Cooper et al. . | |
| 4,183,416 | 1/1980 | Underwood . | |
| 4,183,417 | 1/1980 | Levefelt . | |
| 4,199,856 | 4/1980 | Farrow et al. . | |
| 4,203,496 | 5/1980 | Baker, III et al. | 175/432 |
| 4,225,144 | 9/1980 | Zitz et al. . | |
| 4,249,622 | 2/1981 | Dysart . | |
| 4,253,710 | 3/1981 | Goodman . | |
| 4,256,193 | 3/1981 | Kunkel et al. . | |
| 4,258,806 | 3/1981 | Kunkel et al. . | |
| 4,260,203 | 4/1981 | Garner | 384/96 |
| 4,265,324 | 5/1981 | Morris et al. | 175/428 |
| 4,272,134 | 6/1981 | Levefelt . | |
| 4,279,450 | 7/1981 | Morris . | |
| 4,284,310 | 8/1981 | Olschewski et al. . | |
| 4,285,409 | 8/1981 | Allen | 175/336 |
| 4,287,957 | 9/1981 | Evans . | |
| 4,298,079 | 11/1981 | Norlander et al. . | |
| 4,301,877 | 11/1981 | Cloud | 175/340 |
| 4,343,371 | 8/1982 | Baker, III et al. | 175/430 |
| 4,359,335 | 11/1982 | Garner | 419/6 |
| 4,375,242 | 3/1983 | Galle . | |
| 4,386,668 | 6/1983 | Parish . | |
| 4,386,669 | 6/1983 | Evans | 175/269 |
| 4,388,984 | 6/1983 | Oelke . | |
| 4,421,184 | 12/1983 | Mullins . | |
| 4,442,909 | 4/1984 | Radtke | 175/428 |
| 4,444,281 | 4/1984 | Schumacher, Jr. et al. | 175/336 |
| 4,453,836 | 6/1984 | Klima . | |
| 4,512,426 | 4/1985 | Bidegaray | 175/430 |
| 4,515,228 | 5/1985 | Dolezal . | |
| 4,527,644 | 7/1985 | Allam | 175/333 |
| 4,533,003 | 8/1985 | Bailey et al. . | |
| 4,540,596 | 9/1985 | Nimmagadda . | |
| 4,545,441 | 10/1985 | Williamson | 175/431 |
| 4,552,233 | 11/1985 | Klima . | |
| 4,555,223 | 11/1985 | Frear | 175/337 |
| 4,592,433 | 6/1986 | Dennis | 175/428 |
| 4,593,775 | 6/1986 | Chaney et al. . | |
| 4,595,067 | 6/1986 | Drake | 175/331 |
| 4,597,455 | 7/1986 | Walters et al. . | |
| 4,602,691 | 7/1986 | Weaver | 175/430 |
| 4,608,226 | 8/1986 | Lauvinerie et al. | 419/5 |
| 4,610,319 | 9/1986 | Kalai . | |
| 4,610,452 | 9/1986 | DiRienz . | |
| 4,624,329 | 11/1986 | Evans et al. | 175/374 |
| 4,629,338 | 12/1986 | Ippolito . | |
| 4,688,651 | 8/1987 | Dysart . | |
| 4,690,228 | 9/1987 | Volez et al. | 175/24 |
| 4,694,918 | 9/1987 | Hall | 175/430 |
| 4,705,124 | 11/1987 | Abrahamson et al. | 175/426 |
| 4,722,405 | 2/1988 | Langford, Jr. | 175/374 |
| 4,724,913 | 2/1988 | Morris | 175/430 |
| 4,729,440 | 3/1988 | Hall | 175/107 |
| 4,738,322 | 4/1988 | Hall et al. | 175/371 |
| 4,744,427 | 5/1988 | Grappendorf | 175/430 |
| 4,784,023 | 11/1988 | Dennis . | |
| 4,802,539 | 2/1989 | Hall et al. | 175/371 |
| 4,813,502 | 3/1989 | Dysart . | |
| 4,832,139 | 5/1989 | Minikus et al. | 175/374 |
| 4,865,136 | 9/1989 | White . | |
| 4,926,950 | 5/1990 | Zijsling | 175/39 |
| 4,928,777 | 5/1990 | Shirley-Fisher | 175/430 |
| 4,940,099 | 7/1990 | Deane et al. | 175/374 |
| 4,942,930 | 7/1990 | Millsapps . | |
| 4,967,854 | 11/1990 | Barnetche-Gonzalez | 175/353 |
| 4,976,324 | 12/1990 | Tibbitts | 175/428 |
| 4,981,182 | 1/1991 | Dysart . | |
| 4,984,643 | 1/1991 | Isbell et al. | 175/341 |
| 4,997,049 | 3/1991 | Tank et al. . | |
| 5,025,874 | 6/1991 | Barr et al. | 175/430 |
| 5,027,911 | 7/1991 | Dysart . | |
| 5,080,183 | 1/1992 | Schumacher et al. . | |
| 5,131,480 | 7/1992 | Lockstedt et al. . | |
| 5,145,016 | 9/1992 | Estes . | |
| 5,154,245 | 10/1992 | Waldenstrom et al. | 175/420.2 |
| 5,176,212 | 1/1993 | Tandberg | 175/333 |
| 5,287,936 | 2/1994 | Grimes et al. | 175/331 |
| 5,332,051 | 7/1994 | Knowlton | 175/430 |
| 5,341,890 | 8/1994 | Cawthorne et al. . | |
| 5,346,026 | 9/1994 | Pessier et al. | 175/331 |
| 5,351,768 | 10/1994 | Scott et al. | 175/374 |
| 5,351,770 | 10/1994 | Cawthorne et al. | 175/374 |
| 5,379,854 | 1/1995 | Dennis | 175/434 |
| 5,407,022 | 4/1995 | Scott et al. | 175/374 X |

ROLLER CONE ROCK BIT HAVING IMPROVED CUTTER GAUGE FACE SURFACE COMPACTS AND A METHOD OF CONSTRUCTION

TECHNICAL FIELD OF THE INVENTION

This invention relates in general to the field of roller cone rock bits used in drilling a borehole in the earth, and more particularly to a roller cone rock bit having improved cutter cone gauge face surface compacts and a method of construction.

BACKGROUND OF THE INVENTION

One type of drill bit used in forming a borehole in the earth is a roller cone rock bit. A typical roller cone rock bit comprises a body with an upper end adapted for connection to a drill string. A plurality of arms, typically three, depend from the lower end portion of the body. Each arm includes a spindle protruding radially inward and downward with respect to a projected rotational axis of the body. A cutter cone may be mounted on each spindle and rotatably supported on bearings acting between the spindle and the inside of an internal cavity defined by the cutter cone. One or more nozzles often are located on the underside of the body and radially inward of the arms. These nozzles are generally positioned to direct drilling fluid passing downwardly from the drill string to the bottom of the borehole being formed. The drilling fluid washes away the material removed from the bottom of the borehole and cleanses the cutter cones carrying the cuttings radially outward and upward within the annulus defined between the bit body and the wall of the borehole.

Each cutter cone generally includes a number of insert bits or tooth bits providing drilling surfaces. It is an advantage for the cutter cone and associated bits to provide high penetration rates, resistance to insert bit or tooth bit wear and breakage, and maximum tolerance to impact and unit loading. An additional feature of some cutter cones are compacts press fitted into the gauge face surface of each cutter cone. These compacts assist with cutting the wall of the borehole as the cutter cone rotates. In conventional roller cone rock bits, compacts generally are oriented such that the axis of each compact is perpendicular to the gauge face surface of the cutter cone.

Examples of a roller cone rock bit having compacts or inserts disposed in the gauge face surface of the cutter cone are described in U.S. Pat. Nos. 4,056,153, 5,145,016 and 5,131,480. U.S. Pat. No. 4,056,153 shows rows of gauge face surface compacts on the cutter cones of a roller cone rock bit. U.S. Pat. Nos. 5,145,016 and 5,131,480 both show bit inserts on the gauge face surface of cutter cones in a roller cone rock bit. Each of these patents disclose compacts or inserts on the gauge face surface of a cutter cone that are oriented perpendicular to the gauge face surface. Each of these patents is incorporated by reference for all purposes within this application.

Conventional compacts typically have a body portion and a cutting portion. The body portion may be the part of the compact press fitted into a hole in the gauge face surface of the cutter cone. The cutting portion of each compact includes the part extending outward from the gauge face surface that engages the wall of the borehole. The cutting portion of conventional compacts is sometimes coated to increase resistance to wearing.

Conventional compacts generally are disposed in the cutter cone such that the axis of each compact is approximately perpendicular to the gauge face surface. With this orientation, the cutting portion of the compacts impinge upon the wall of the borehole such that the side of each compact engages the wall. The force absorbed by the side of each compact causes wear of the compacts and reduces the lifetime of the roller cone rock bit.

SUMMARY OF THE INVENTION

A need has arisen for a roller cone rock bit having cutter cone gauge face surface compacts that have a longer lifetime thus increasing the lifetime of the roller cone rock bit.

In accordance with the present invention, a roller cone rock bit having improved cutter cone gauge face surface compacts and a method of construction are provided that substantially eliminate or reduce disadvantages and problems associated with gauge face surface compacts of prior roller cone rock bits.

According to one embodiment of the present invention, a roller cone rock bit is provided that has improved cutter cone gauge face surface compacts. The roller cone rock bit includes a bit body having at least one downwardly extending arm terminating in a spindle. A cutter cone may be provided that has a gauge face surface. A bearing assembly may be disposed between the spindle and the cutter cone for rotary load-bearing engagement. A plurality of holes are preferably formed in the gauge face surface on the exterior of the cutter cone. Each hole in the plurality of holes has an axis oriented at an acute angle with respect to the gauge face surface. A plurality of compacts are disposed in the plurality of holes. Each compact is preferably oriented at an angle with respect to the gauge face surface corresponding to the axis of each hole.

Technical advantages of the present invention include providing cutter cone gauge face surface compacts oriented such that the axis of each compact is angled with respect to the gauge face surface in a direction toward the direction of rotation of the cutter cone. The compacts are preferably disposed in the cutter cone at a back rake angle such that the top surface of each compact engages the wall of the borehole.

Other technical advantages of the present invention include the orientation of gauge face surface compacts of a cutter cone such that the axis of each compact is angled with respect to the gauge face surface in a direction perpendicular to the direction of rotation of the cutter cone.

Further technical advantages of the present invention include using polycrystalline diamond compacts disposed in the gauge face surface of a cutter cone where the compacts are oriented such that the axis of each compact is disposed at a selected angle with respect to the gauge face surface of the cutter cone and the direction of rotation of the cutter cone.

BRIEF DESCRIPTION OF THE DRAWINGS

A more complete understanding of the present invention may be acquired by referring to the following description taken in conjunction with the accompanying drawings in which like reference numbers indicate like features and wherein.

DETAILED DESCRIPTION OF THE INVENTION

Figure 1:
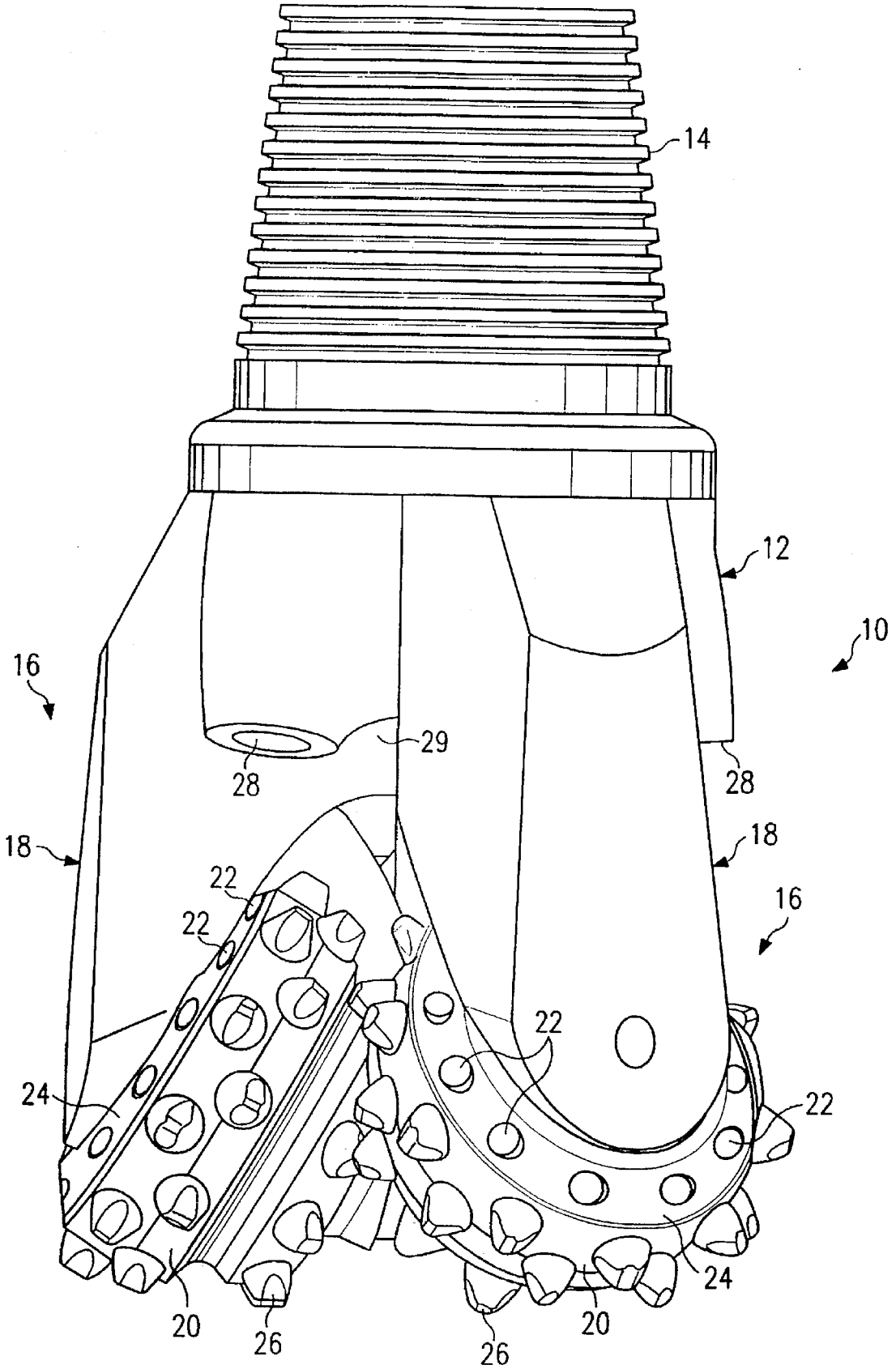
FIG. 1 illustrates an isometric view of a roller cone rock bit constructed according to the teachings of one aspect of the present invention.
Figure 2:
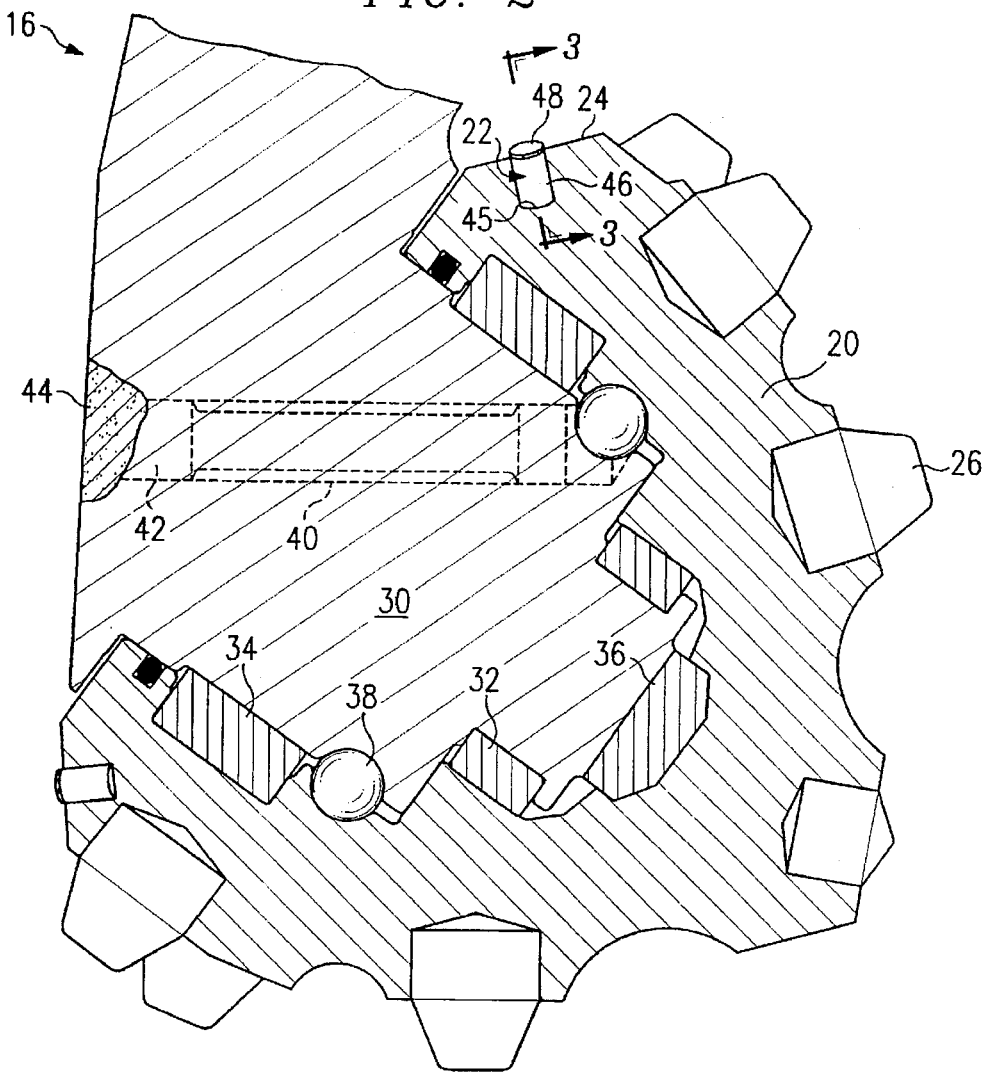
FIG. 2 illustrates a cross-sectional view with portions broken away of a support arm of a cutter assembly of a roller cone rock bit constructed according to the teachings of one aspect of the present invention.
Figure 3:
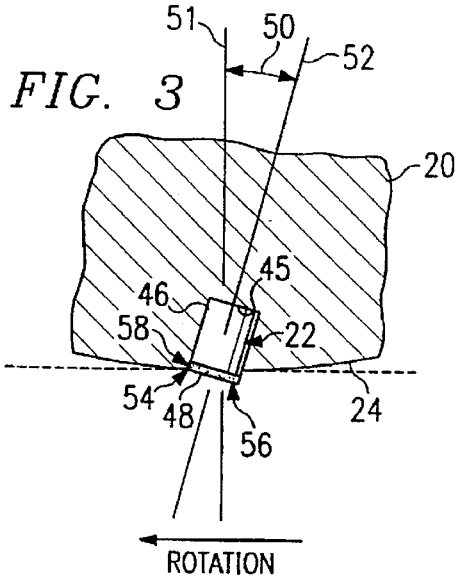
FIG. 3 illustrates an enlarged cross-sectional view with portions broken away of a gauge face surface compact constructed according to the teachings of one aspect of the present invention.

The present invention and its advantages are best understood by referring to FIGS. 1–3 of the drawings, like numerals being used for like and corresponding parts of the drawings.

FIG. 1 illustrates a roller cone rock bit, indicated generally at 10, constructed according to the teachings of one aspect of the present invention. Roller cone rock bit 10 drills a borehole by the cutting action of cutter cones 20 as roller cone rock bit 10 is rolled around the bottom of the borehole (not shown) by the rotation of a drill string (not shown) attached to roller cone rock bit 10.

Roller cone rock bit 10 comprises a bit body 12 having a tapered, externally threaded upper section 14 adapted to be secured to the lower end of the drill string (not shown). Three cutter assemblies (two visible in FIG. 1) indicated generally at 16, depend from bit body 12. Each cutter assembly 16 comprises a support arm 18 and a cutter cone 20.

Each cutter cone 20 includes a number of compacts 22 disposed in a gauge face surface 24 of each cutter cone 20. Each cutter cone 20 also includes a number of inserts 26. In one embodiment of the present invention, each compact 22 comprises a polycrystalline diamond compact having a body portion and a diamond cutting portion as described in more detail with respect to FIG. 2 and FIG. 3. Each compact 22 may be oriented with respect to gauge face surface 24 such that an axis of each compact 22 is angled toward the direction of rotation of the associated cutter cone 20. In another embodiment of the present invention, each compact 22 is also oriented such that the axis of each compact 22 is angled with respect to gauge face surface 24 and approximately perpendicular to the direction of rotation of the associated cutter cone 20. This angled orientation of compacts 22 is described in more detail with respect to FIG. 2 and FIG. 3.

Roller cone rock bit 10 operates to scrape and gauge the sides and bottom of the borehole utilizing compacts 22 and inserts 26 under downhole force supplied through the drill string. Alternative embodiments of the present invention include cutter cones that have milled teeth rather than inserts. The teachings of the present invention are equally beneficial to such embodiments. The formation of borehole debris is carried away from the bottom of the borehole by a drilling fluid ejected from a number of nozzles 28 extending from an underside 29 of roller cone rock bit 10. The drilling fluid generally flows radially outward between the underside of the exterior of roller cone rock bit 10 and the borehole bottom. The drilling fluid then flows upwardly towards the surface through an annulus defined between roller cone rock bit 10 and the sidewall of the borehole.

FIG. 2 illustrates a cross-sectional view of one cutter assembly 16 with support arm 18 of roller cone rock bit 10 of FIG. 1. Support arm 18 includes a downwardly and inwardly extending spindle 30. Cutter cone 20 is shaped to receive spindle 30. Roller bearings 32 and roller bearings 34 are positioned for rotational bearing engagement between cutter cone 20 and spindle 30. As is shown, a thrust button 36 also is positioned for thrust-bearing engagement between cutter cone 20 and spindle 30. Cutter cone 20 is retained on spindle 30 by a plurality of ball bearings 38 inserted through a ball passage 40 in spindle 30. Ball bearings 38 reside in an annular array between spindle 30 and cutter cone 20. Once inserted, ball bearings 38 prevent the disengagement of cutter cone 20 from spindle 30. Ball passage 40 subsequently is plugged with a ball plug 42 welded at 44 into ball passage 40.

As illustrated in FIG. 2, compacts 22 are disposed in holes 45 drilled in gauge face surface 24 of cutter cone 20. Each compact 22 comprises a body portion 46 and a cutting portion 48. Body portion 46 and cutting portion 48 may be constructed from the same material or from different materials. Cutting portion 48 engages the wall of the borehole when roller cone rock bit 10 is utilized to drill a borehole.

According to the teachings of the present invention, compacts 22 may be selectively oriented with respect to gauge face surface 24 such that an axis of each compact 22 is angled with respect to gauge face surface 24. In the illustrated embodiment, holes 45 are drilled into cutter cone 20 for receiving compacts 22 at a back rake angle. The back rake angle is the angle between a line normal to gauge face surface 24 and the axis along which holes 45 are drilled. Compacts 22 are generally cylindered with outer dimensions corresponding approximately with the inner dimensions of holes 45. After being press fitted into holes 45, each compact 22 is angled with respect to gauge face surface 24 according to the back rake angle of holes 45. In the illustrated embodiment, compacts 22 are angled towards the direction of rotation of cutter cone 20. In a further embodiment of the present invention, holes 45 are drilled such that each compact 22 is also oriented at an angle with respect to gauge face surface 24 in a direction perpendicular to the direction of rotation of cutter cone 20. The orientation of compacts 22 is described in more detail with respect to FIG. 3.

In one embodiment of the present invention, each compact 22 comprises a polycrystalline diamond compact for which body portion 46 is constructed from tungsten carbide and cutting portion 48 is constructed from polycrystalline diamond. A polycrystalline diamond compact may be formed by providing a layer of graphite (not shown) on top of tungsten carbide powder and compressing the mixture at high temperature and pressure. The graphite forms into a diamond layer on the surface of a carbide compact 22 which is then interference fit into holes 45 formed in gauge face surface 24 of cutter cone 20. Polycrystalline diamond compacts may also be formed from larger compacts salvaged from a used polycrystalline diamond compact bit, polycrystalline diamond bearing or other such device employing polycrystalline diamond compacts. Generally, polycrystalline diamond compacts are less expensive to manufacture than carbon vapor deposition of diamond on milled teeth.

FIG. 3 illustrates an enlarged cross-sectional view of one compact 22 of FIG. 2. As shown in FIG. 3, compact 22 is oriented with a back rake angle 50 such that compact 22 is tilted toward the direction of rotation of cutter cone 20. Back rake angle 50 is the angle between a line 51 normal to the tangent of gauge face surface 24 and an axis 52 of compact 22 and of hole 45. In the embodiment of FIG. 3, back rake angle 50 is sufficient to cause a leading edge 54 of cutting portion 48 to be substantially coextensive with gauge face surface 24 of cutter cone 20. Orienting compact 22 at back rake angle 50 insures that compact 22 impinges on the wall of the borehole such that a top surface 56 of cutting portion 48 engages the wall of the borehole when roller cone rock bit 10 is utilized to drill a borehole. In one embodiment of the present invention, back rake angle 50 is approximately fifteen degrees. Generally, back rake angle 50 may range between three and fifteen degrees but also may extend outside this range for some applications. One such embodiment is described with respect to FIG. 4.

Top surface 56 is more resistant to shearing forces than a side surface 58 of cutting portion 48. Back rake angle 50 prevents or reduces chipping and wear of cutting portion 48 and is particularly beneficial where cutting portion 48 is constructed from polycrystalline diamond. Where cutting portion 48 is constructed from polycrystalline diamond, the orientation of compact 22 insures a longer lifetime of the diamond material. Back rake angle 50 of compact 22 also reduces the torque experienced by roller cone rock bit 10 as it drills the borehole.

In a further embodiment of the present invention, hole 45 and compact 22 are oriented such that axis 52 is angled with respect to gauge face surface 24 of cutter cone 20 in a direction perpendicular to the direction of rotation of cutter cone 20 on a plane including line 51. Axis 52 of hole 45 can be angled with respect to gauge face surface 24 as appropriate for the desired application.

Figure 4:
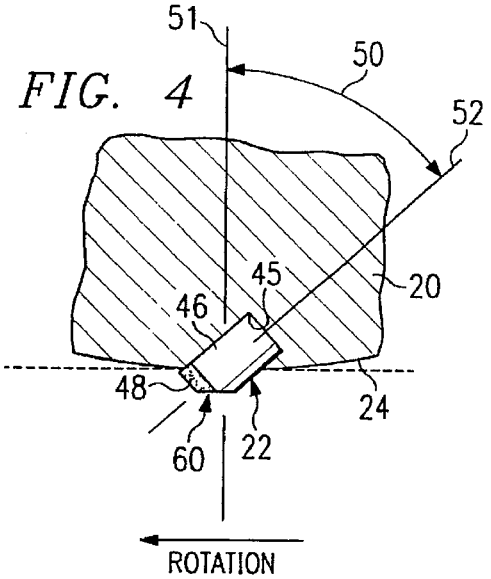
FIG. 4 illustrates an enlarged cross-sectional view with portions broken away of another embodiment of a gauge face surface compact constructed according to the teachings of the present invention.

FIG. 4 illustrates an enlarged cross-sectional view of another embodiment of compact 22. As shown in FIG. 4, compact 22 is oriented with a back rake angle 50 that is larger than that shown in FIG. 3. Compact 22 also comprises a flat area 60, as shown. Back rake angle 50 is large such that compact 22 can impart cutting action to the sides of the borehole wall to facilitate steering of roller cone rock bit 10 in a planned direction. Further, steering can be facilitated by increasing exposure of compact 22 and by orienting compact 22 at an angle having a component perpendicular to the direction of rotation. Orientation of compact 22 can facilitate steering of roller cone rock bit 10 and increase side cutting action.

The teachings of the present invention benefit roller cone rock bits having compacts 22 for which body portion 46 and cutting portion 48 are constructed from the same or different materials. The orientation of compact 22 to prevent contact of side surface 58 with the wall of the borehole prevents wear and chipping of compact 22 and reduces the torque experienced by roller cone rock bit 10. Although FIG. 1 illustrates compacts 22 lined along a common circumference, other orientations are possible. Compacts 22 may be staggered or spaced as appropriate for the desired application. Further, the size of each compact 22 and the thickness of cutting portion 48 may be set appropriately for the desired application.

Technical advantages of the present invention include providing cutter cone gauge face surface compacts oriented such that the axis of each compact is angled with respect to the gauge face surface in a direction toward the direction of rotation of the cutter cone. The compacts are preferably disposed in the cutter cone at a back rake angle such that the top surface of each compact engages the wall of the borehole.

Other technical advantages of the present invention include orientation of gauge face surface compacts of a cutter cone such that the axis of each compact is angled with respect to the gauge face surface in a direction perpendicular to the direction of rotation of the cutter cone.

Further technical advantages of the present invention include using polycrystalline diamond compacts disposed in the gauge face surface of a cutter cone where the compacts are oriented such that the axis of each compact is disposed at a selected angle with respect to the gauge face surface of the cutter cone and the direction of rotation of the cutter cone.

Although the present invention has been described in detail, it should be understood that various changes, substitutions and alterations can be made hereto without departing from the spirit and scope of the invention as defined by the appended claims.

What is claimed is:

1. A roller cone rock bit, comprising:

a bit body having at least one downwardly extending arm terminating in a spindle;

a cutter cone having gauge face surface and having a plurality of holes formed in the gauge face surface each hole in the plurality of holes having an axis oriented at an acute angle with respect to the gauge face surface;

a bearing assembly disposed between the spindle and the cutter cone for rotary load-bearing engagement;

a plurality of compacts disposed in the plurality of holes, each compact oriented at an acute angle with respect to the gauge face surface according to the axis of each hole; and wherein the axis of at least one hole in the plurality of holes is further oriented such that the axis of the at least one hole is angled in a direction having a component perpendicular to a direction of rotation of the cutter cone.

2. The roller cone rock bit of claim 1, wherein at least one compact further comprises a body portion and a cutting portion constructed from the same material, such that the body portion and the cutting portion are formed as an integral part of the at least one compact.

3. The roller cone rock bit of claim 1, wherein at least one compact further comprises a body portion and a cutting portion, the cutting portion constructed from a first material and the body portion constructed from a second material.

4. The roller cone rock bit of claim 3, wherein the cutting portion of the at least one compact is constructed from polycrystalline diamond.

5. The roller cone rock bit of claim 1, wherein the at least one compact is formed from a larger polycrystalline diamond compact salvaged from a used device employing polycrystalline diamond compacts.

6. The roller cone rock bit of claim 1, wherein the axis of at least one hole in the plurality of holes is oriented at an angle such that the angle is a back rake angle.

7. The roller cone rock bit of claim 6, wherein the back rake angle is sufficient to position a leading edge of the at least one compact substantially coextensive with the gauge face surface.

8. The roller cone rock bit of claim 6, wherein the back rake angle is selected to be in the range from three to fifteen degrees.

9. The roller cone rock bit of claim 1, wherein the axis of at least one hole in the plurality of holes is oriented such that a compact disposed in the at least one hole is positioned to impart cutting action to sides of a borehole for increased side cutting.

10. The roller cone rock bit of claim 1, wherein the axis of at least one hole in the plurality of holes is oriented such that a compact disposed in the at least one hole is positioned to facilitate steering the roller cone rock bit in a desired direction during drilling.

11. A roller cone rock bit, comprising:

a bit body having at least one downwardly extending arm terminating in a spindle;

a cutter cone having a gauge face surface and having a plurality of holes formed in the gauge face surface, each hole in the plurality of holes having an axis oriented at an acute angle with respect to the gauge face surface, wherein at least one compact in the plurality of compacts further comprises a body portion and a cutting portion, the cutting portion constructed from a first material and the body portion constructed from a second material;

a bearing assembly disposed between the spindle and the cutter cone for rotary load-bearing engagement;

a plurality of compacts disposed in the plurality of holes, each compact oriented at an acute angle with respect to the gauge face surface according to the axis of each hole, wherein the axis of at least one hole in the plurality of holes is oriented at an angle such that the angle is a back rake angle sufficient to position a leading edge of the at least one compact substantially coextensive with the gauge face surface; and wherein the axis of at least one hole in the plurality of holes is oriented such that a compact disposed in the at least one hole is positioned to facilitate steering the roller cone rock bit in a desired direction during drilling.

12. The roller cone rock bit of claim 11, wherein the at least one compact comprises a polycrystalline diamond compact.

13. The roller cone rock bit of claim 12, wherein at least one compact is formed from a larger polycrystalline diamond compact salvaged from a used device employing polycrystalline diamond compacts.

14. The roller cone rock bit of claim 11, wherein the axis of at least one each hole in the plurality of holes is further oriented such that the axis of the at least one hole is angled in a direction having a component perpendicular to a direction of rotation of the cutter cone.

15. A method of constructing a roller cone rock bit, comprising the steps of:

forming a plurality of holes in a gauge face surface of a cutter cone of the roller cone rock bit such that an axis of each hole is oriented at an acute angle with respect to the gauge face surface and such that the axis of at least one hole is oriented to facilitate steering the roller cone rock bit in a desired direction during drilling;

providing a plurality of compacts;

disposing the plurality of compacts in the plurality of holes such that each compact is oriented according to the angle of the axis of each hole; and coupling the cutter cone to a spindle of the roller cone rock bit.

16. The method of claim 15, wherein the step of providing a plurality of compacts comprises providing a plurality of compacts wherein a cutting portion of at least one compact is constructed from the same material and is integral with a body portion of the at least one compact.

17. The method of claim 15, wherein the step of providing a plurality of compacts comprises providing a plurality of compacts wherein a cutting portion of at least one compact is constructed from a first material and a body portion of the at least one compact is constructed from a second material.

18. The method of claim 17, wherein the cutting portion of the at least one compact is constructed from polycrystalline diamond.

19. The method of claim 18, wherein the step of providing a plurality of compacts comprises forming the at least one compact from graphite and tungsten carbide powder.

20. The method of claim 15, wherein the step of providing a plurality of compacts comprises forming at least one compact from a larger polycrystalline diamond compact salvaged from a used device employing polycrystalline diamond compacts.

21. The method of claim 15, wherein the step of forming the plurality of holes comprises forming at least one hole such that the axis of the at least one hole is oriented at an angle such that the angle is a back rake angle.

22. The method of claim 21, wherein the back rake angle is sufficient to position a leading edge of the at least one compact substantially coextensive with the gauge face surface.

23. The method of claim 21, wherein the axis of each hole in the plurality of holes is further oriented such that each hole is angled in a direction having a component perpendicular to a direction of rotation of the cutter cone.

24. A method of constructing a roller cone rock bit, comprising the steps of:

forming a plurality of holes in a gauge face surface of a cutter cone of a roller cone rock bit such that an axis of each hole is oriented at an acute angle with respect to the gauge face surface and such that each hole is angled in a direction having a component perpendicular to a direction of rotation of the cutter cone;

providing a plurality of compacts;

disposing the plurality of compacts in the plurality of holes such that each compact is oriented according to the angle of the axis of each hole;

coupling the cutter cone to a spindle of the roller cone rock bit; and wherein the step of forming the plurality of holes comprises forming at least one hole such that the axis of the at least one hole is oriented at an angle such that the angle is a back rake angle.

* * * * *